United States Patent [19]

Aiuola et al.

[11] Patent Number: 4,928,942

[45] Date of Patent: May 29, 1990

[54] DEVICE FOR FEEDING FLATTENED BOXES IN PACKAGING MACHINES

[75] Inventors: Franco Aiuola, Bologna; Herbert Rueff, Casalecchio Di Reno, both of Italy

[73] Assignee: Azionaria Costruzioni Macchine Automatiche A.C.M.A. S.p.A., Bologna, Italy

[21] Appl. No.: 183,210

[22] Filed: Apr. 19, 1988

[30] Foreign Application Priority Data

Apr. 24, 1987 [IT] Italy ..... 3446A/87

[51] Int. Cl.[5] ..... B65H 39/04

[52] U.S. Cl. ..... 210/58; 271/3.1; 271/150; 271/216

[58] Field of Search ..... 270/54, 58; 271/216, 271/184, 185, 3.1, 149, 150, 151; 198/462, 422–426

[56] References Cited

U.S. PATENT DOCUMENTS

| | | | |
|---|---|---|---|
| 3,232,606 | 2/1966 | Crooks | 271/150 |
| 3,236,162 | 2/1966 | Reist | 271/216 |
| 3,700,232 | 10/1972 | Wiegert | 271/216 |
| 3,842,719 | 10/1974 | Fernandez-Rana | 271/216 |
| 4,058,226 | 11/1977 | Peters, Jr. | 271/216 |
| 4,125,253 | 11/1978 | Wangermann | 270/58 |
| 4,240,539 | 12/1980 | Klapp | 271/151 |
| 4,531,343 | 7/1985 | Wood | 271/151 |
| 4,718,656 | 1/1988 | Reist | 271/3.1 |
| 4,732,262 | 3/1988 | Labombarde | 271/150 |

*Primary Examiner*—Robert E. Garrett
*Assistant Examiner*—Therese M. Newholm
*Attorney, Agent, or Firm*—Guido Modiano; Albert Josif

[57] ABSTRACT

The device for feeding flattened boxes comprises a magazine arranged at the output of a feeder, such as a folding-pasting machine and provided with advancement means adapted to collect boxes, which exit in a line horizontally superimposed in a sequential manner from the feeder, and to accumulate them in stacks. The device then transfers the boxes into a vertically flattened position, at a zone which cooperates with a packaging machine extractor.

18 Claims, 3 Drawing Sheets

DEVICE FOR FEEDING FLATTENED BOXES IN PACKAGING MACHINES

BACKGROUND OF THE INVENTION

The present invention relates to a device for feeding flattened boxes in packaging machines. Such packaging machines may be of the type fed by box feed means, such as machines for the folding and pasting of said boxes.

As is known, boxes in cardboard or other sheet material, intended for the packaging of products in general, are usually preset in a flattened tubular shape and subsequently fed to the packaging machine by means of a feeder device of the type of those described in Italian Patent No. 779631 and Appln. No. 3445A/85 in the name of the same Assignee.

Said feeders substantially comprise a magazine forwardly delimited by an extraction zone. With an appropriate pressure, the boxes arranged in line in the magazine are kept pressed against abutment elements defining said zone, whereat suckers operate to extract the boxes in succession, according to the cycle of the machine, and open them out into a tubular shape interacting with appropriate elements.

The boxes of the magazine are supported by advancement means, in practice constituted by a chain, adapted to keep said boxes pressed against the extraction zone while some are progressively extracted. Said advancement means move longitudinally with respect to the magazine towards the extraction zone, in convenient relation to the corresponding means of the packaging machine.

The boxes to be fed are folded so that their lateral surface and the flaps derived therefrom and intended to define the ends of said box are arranged on one or the other of two mutually adjacent planes.

To pre-dispose the flattened boxes, folding-pasting machines are known, in the field of the manufacture of paper and cardboard articles, of the type for example of those named Studio 60-80 of the Grassi S.a.s. company of Paderno Dugnano (Italy), Diana 125-1 of the Jagenberg-Werke AG of Duesseldorf (Federal Republic of Germany), and Lemanic 650 of the Bobst-Champlain company of Lausanne (Switzerland). In these machines the punched cardboards intended to form the boxes generally undergo a scoring, the pasting of a small longitudinal flap and a series of closing folds; the boxes are then conveyed in a row to the output, and partially superimposed in a sequential manner.

Currently, at the output of the folding-pasting machine the flattened boxes are collected and packed for shipping to the site of use. There the flattened boxes, in a pack, are arranged manually, with a certain frequency, in the feeder of the packaging machine.

It is apparent that the resupply of the packaging machine, besides requiring specific personnel, entails a time interval between the operations of folding and pasting the boxes in flattened shape, performed by the paper-article factory, and the successive operations of filling and closure in the packaging machine. Thus the possibility arises of the occurrence of deformations of the flattened boxes, due to the tensions caused on the cardboard by the setting of the paste, with consequent malfunctions during packaging.

SUMMARY OF THE INVENTION

The aim of the present invention is to solve the above described problem by providing a device for feeding flattened boxes which allows the automatic resupply of the packaging machine from the machine for the folding and pasting of said boxes, in such a particular manner as to ensure the optimum packaging of products in said boxes.

Within this aim, an object of the present invention is to provide a device for feeding flattened boxes which is simple in concept, safe and reliable in operation and economically advantageous in use, in particular with respect to the saving in personnel.

This aim and object and others which will become apparent hereinafter are both achieved, according to the invention, by the present device for feeding flattened boxes, which is characterized in that it comprises a magazine provided with advancement means adapted to collect boxes, partially superimposed in a sequential manner, from a feed means and to accumulate them in a pack, transferring them into a flattened position, at a zone adapted for cooperation with the extraction means of a packaging machine.

BRIEF DESCRIPTION OF THE DRAWINGS

The details of the invention will become apparent from the detailed description of a preferred embodiment of the device for feeding flattened boxes, illustrated only by way of non-limitative example in the accompanying drawings, wherein.

DESCRIPTION OF THE PREFERRED EMBODIMENTS

Figure 1:
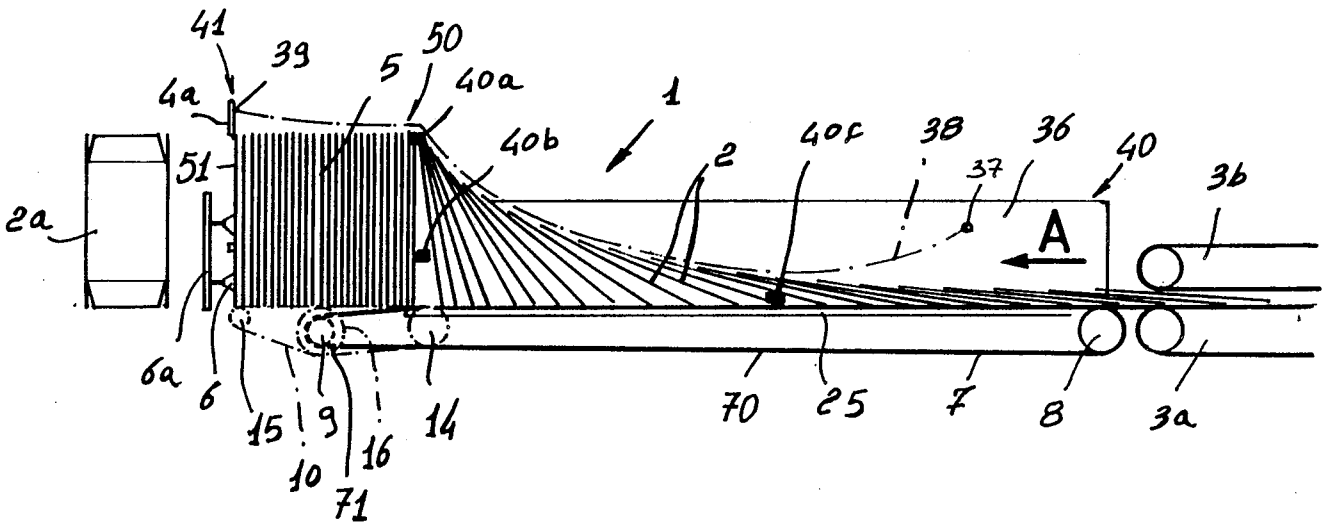
FIG. 1 is a schematic lateral view of the device according to the invention.

With particular reference to the above described figures, the reference numeral 1 generally indicates a device which is adapted to feed with flattened boxes 2, a conventional packaging machine, not illustrated in the drawing. The feeder device 1 can be arranged, for example, at the output of a known type of folding-pasting machine, of which in FIG. 1 one can see the conveyor belts 3*a*, 3*b* where between flattened boxes 2 exit in a row, are partially superimposed upon each other in a sequential manner.

The feeder device 1 is substantially constituted by a box magazine 50 defining an inlet zone 40, which is forwardly delimited by an extraction zone 41. The extraction zone 41 is defined in a known manner by upper and lateral abutment elements indicated respectively by the reference numerals 4*a*, 4*b*, against which a pack 5 of said flattened boxes 2 is normally held pressed. Between said extraction zone 41 and the inlet zone 40 of the packaging machine there operate, again in a known manner, suckers 6 which intermittently extract from the abutments 4*a*, 4*b* the front box 51 (see FIG. 1) of the pack 5 and open it into a tubular shape, as indicated by the reference numeral 2*a*; the suckers 6 are mounted on an upright 6*a* which is controllably oscillable about its own vertical axis in a conventional manner.

The flattened boxes 2 forming the pack 5 are arranged vertically and packed flat within the magazine 50.

Downwardly, the magazine 50 is delimited by upper active branches of first advancement means 70 for the advancement of the boxes 50, constituted by a pair of belts 7 which are each trained around a drive pulley 8 and a return pulley and 9 to define a closed-loop formation. Said first advancement means 70 constitute a continuation of the conveyor belts 3*a*, 3*b* of the folding-pasting machine, so as to support the rows of flattened boxes 2 existing therefrom, and are in turn extended by second advancement means 100, constituted by a pair of chains 10, each defining a closed loop formation and being arranged to support the pack 5 of flattened boxes 2 pressed against the abutments 4*a*, 4*b* defining the extraction zone 41.

The belts 7 are arranged closer to each other with respect to the chains 10, and a forward portion 71 defined by said first advancement means 70 may be located between the chains 10 of said second advancement means 100.

The drive pulleys 8, arranged at the inlet zone 40 of the magazine 50 adjacent to the folding-pasting machine, are coupled by means of a first key 11 to a first drive actuating shaft 12 for the belts 7, said first drive shaft 12 being actuated by appropriate motorized drive means. The return pulleys 9, arranged at the extraction zone 41 of the magazine 50, are rotatably idly mounted on a second drive shaft 13 which is acuated for driving the chains 10.

The chains 10 as will be described hereinafter (which for the sake of clarity are not illustrated in FIG. 2,) are each trained around a pair of toothed wheels 14 a second toothed wheel and 15 and are to define a closed configuration having a central portion engaging in meshing engagement, relationship drive gear 16, keyed to the second drive shaft 13 by means of a second key 17. The first and second toothed wheels 14 and 15 are rotatably supported by guides 18 and 19, the central to act as supports for related portions of the closed-loop configurations defined by the chains 10, proximate to where at the region of the chains 10 engage, in meshing engagement relationship with the drive gear 16. The guides 18 and 19 are supported by a frame 20 rigidly associated with a crosspiece 21 of a fixed framework 22 of the device; the sleeves 23 and 24, rotatably support the first drive shaft 12 and 13, the second shaft and are also fixed to said framework 22.

Figure 2:
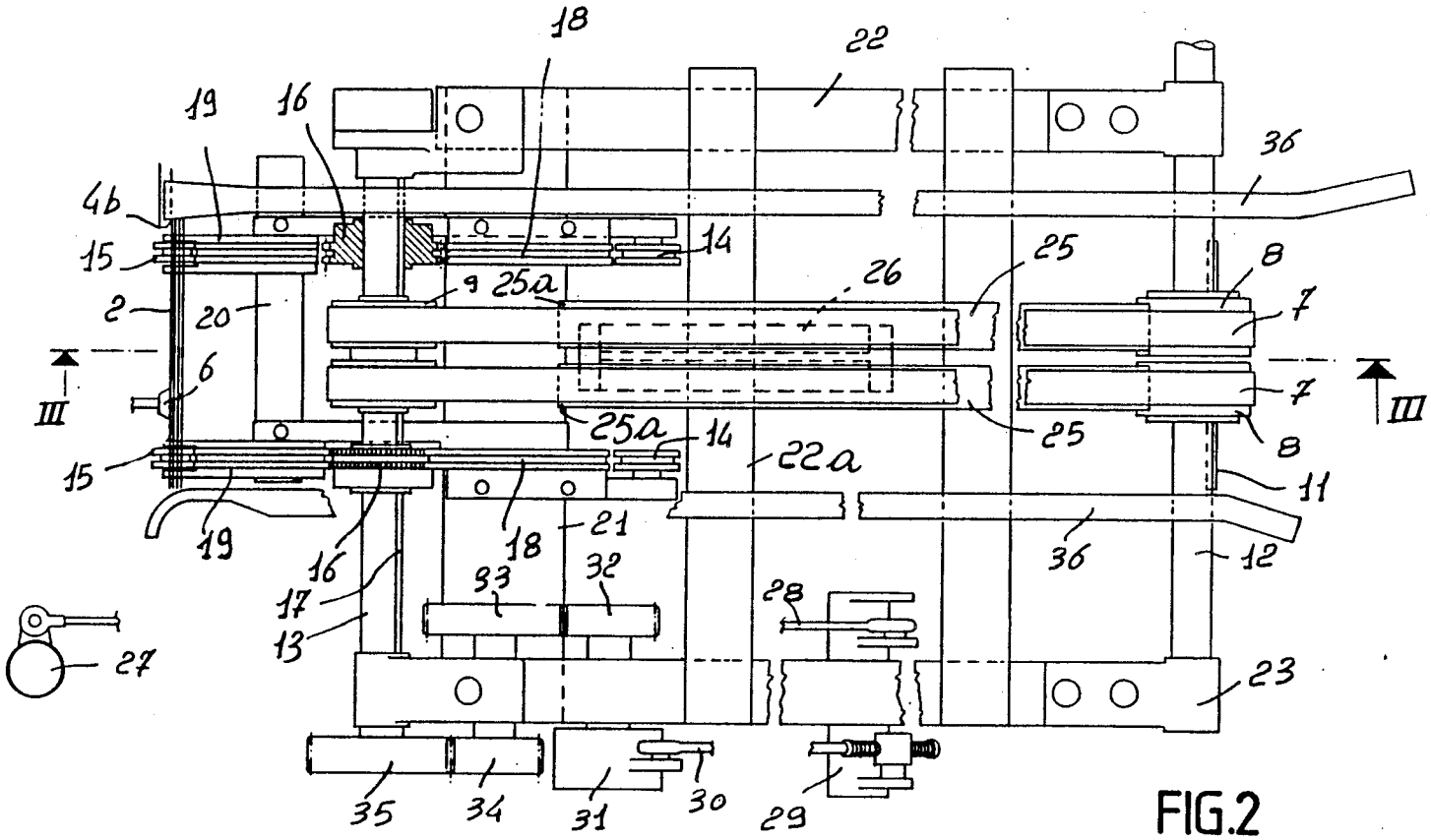
FIG. 2 is a partially cut-away plan view thereof.
Figure 3:
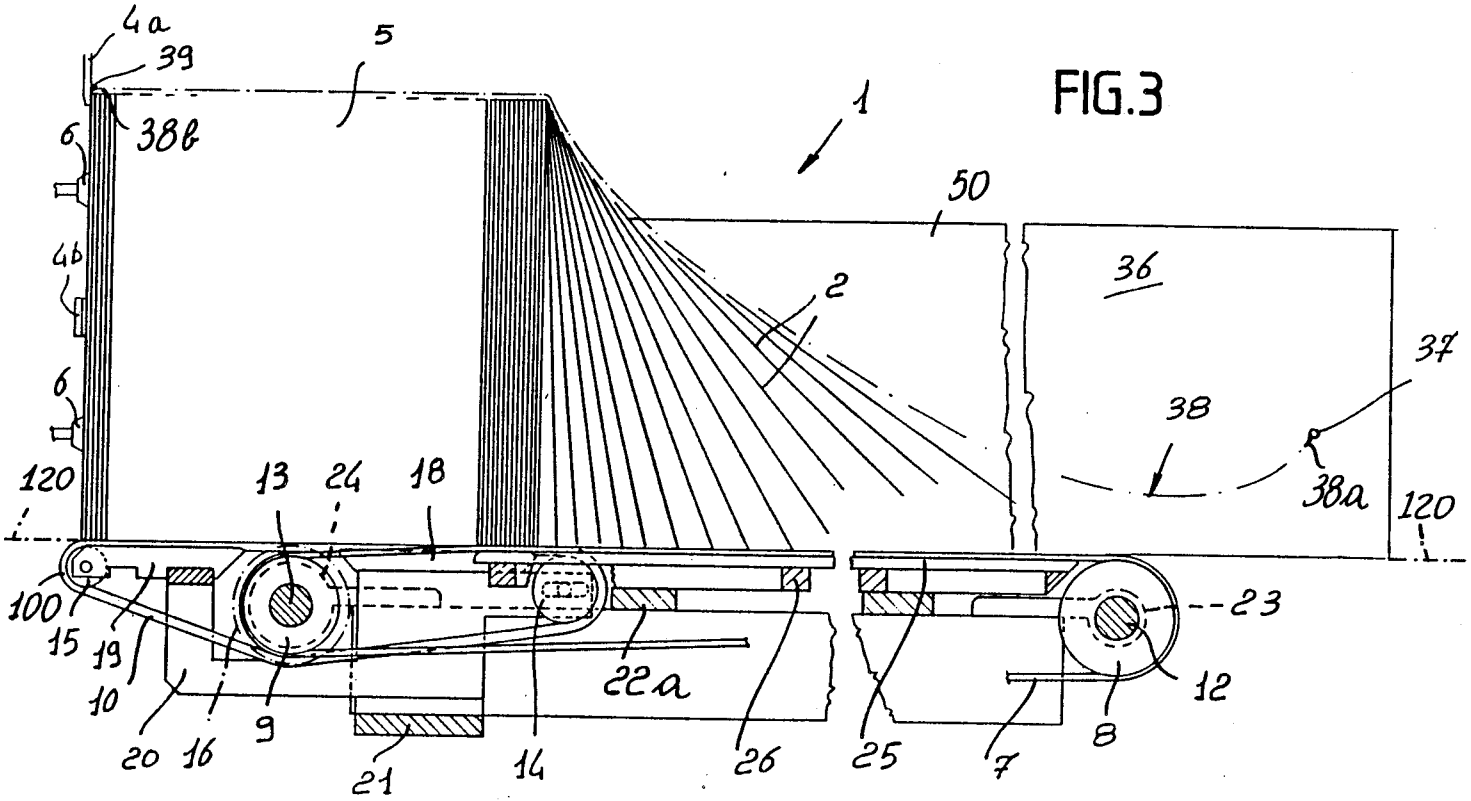
FIG. 3, finally, is a vertical sectional view taken along the line III—III of FIG. 2.

The closed-loop formations defined by the belts 7 of the first actuating means 70 are in turn upward slideably supported, by respective sliders 25, mounted on a frame 26 associated with a cross-member 22*a* of the framework 22 (see FIGS. 2 and 3). The frame may be slideably associated with the cross-member 22*a* for arranging the sliders 25 longitudinally with respect to the first advancement means 70 of the device, so that the front end 25*a* of the sliders 25 defines a passage zone whereat the flattened boxes 2 pass from the first advancement means 70 to the second advancement means 100. The front upper portion of the closed-loop formation defined by each of the belts 7 is slightly downwardly included starting from said passage zone, as clearly visible in FIG. 3.

The sliders 25 and the guides 18, 19 on which the belts 7 and the chains 10 respectively slide define a plane extending parallel to a single uninterrupted linear advancement plane 120 of flattened the boxes 2 inside the magazine 50, co-planar to the output belt 3*a* of the folding-pasting machine. (See FIG. 3)

The second drive shaft 13 for motorizing the chains 10 is actuated by a reciprocating element 27 which, by means of first a connecting rod 28, controls the oscillation of a transmission shaft 29; the transmission shaft 29, by means of a second connecting rod 30, controls in turn a non-return device 31 which actuates the pairs of gears 32, 33 and 34, 35 by means of which motion is transmitted to the second drive shaft 13.

The flattened boxes 2, which advance inside the magazine 50 in the direction indicated by the arrow A, (FIG. 1) are longitudinally guided between a pair of walls 36, arranged symmetrically and laterally with respect to said first advancement means 70 and said second advancement means 100. Conveniently, the mutual distance between the walls 36, as well as the distance between the belts 7 and the chains 10, is adjustable according to the dimensions of the boxes to be fed.

Between the lateral walls 36 a coupling member 37 is associated with one end 38*a* of a chain member 38, (indicated in broken lines), which has another end 38*b* rigidly associated at function 39 with the upper abutment 4*a* of the extraction zone 41. As visible in the drawing, the chain member 38, expediently obtained from a series of small mutually hinged plates in plastic material, is arranged in the front portion on the pack 5 of the flattened boxes 2 and then descends according to the profile of a curve in the subsequent portion, so as to elastically act as an upper guide for the transfer of the boxes 2 from a substantially horizontal position to a vertical position. In fact, the boxes which exit horizontally superimposed in a sequential manner from the folding-pasting machine, are advanced by the belts 7 are, are forced to slide on one another so as to progressively reach the same vertical position of the flattened boxes 2 constituting the pack 5, which acts as a initial abutment for the row of boxes advancing on said belts 7.

For this purpose the speed of advancement of said first advancement means and said second advancement means 100 is conveniently different, the speed of the chains 10 being related to the speed of extraction of the suckers 6.

Conveniently, along the path of the boxes being advanced a series of photocells 40*a*, 40*b* and 40*c* is arranged, intended respectively to detect an excess of said boxes, a shortage thereof and a possible lack of feed by the folding-pasting machine or other feed means, so as to accordingly control the stop or, vice versa, the feeding of the folding-pasting machine or the stop of the packaging machine.

The described device automatically provides, to conclude, the packing of the flattened boxes intended to feed the packaging machine, moving them into the conventional vertical position of extraction by the suckers 6 of said machine.

It should be noted that, besides an obvious saving in labor and an increase in productivity, the device allows to uninterruptedly perform the operations of folding and pasting of the box and the successive ones of packaging and closure of the heads. Therefore, since the time elapsing between the successive operations is short, deformations of the cardboard as an effect of the setting of the paste do not occur.

In the practical embodiment of the invention, the materials employed, as well as the shape and dimensions, may be any according to the requirements.

What is claimed:

1. A device for feeding flattened boxes from a folding-pasting machine to a packaging machine, said device comprising;

a supporting framework, at least one box magazine mounted on said framework and defining a box inlet zone, whereat flattened boxes are laid substantially horizontally and sequentially superimposed and a box extraction zone, abutment means located at said extraction zone for positioning boxes substantially vertically at said extraction zone of said magazine, and means for conveying flattened boxes from said box inlet zone to said box extraction zone, wherein said means for conveying flattened boxes from said box inlet zone to said box extraction zone upwardly define a single uninterrupted linear advancement plane, and wherein said means for conveying flattened boxes from said inlet zone to said box extraction zone comprise;

first drive means, a first drive shaft rotatably associated with said framework and being driven by said first drive means, at least two drive pulleys keyed to said first drive shaft, intermittent drive means, a second drive shaft rotatably associated with said framework and being driven by said intermittent drive means, at least two return pulleys rotatably idly journalled on said second drive shaft, at least two belts trained around said drive pulleys and said return pulleys and each defining a closed-loop formation, at least one frame fixed to said fixed framework, at least two guides supported by said frame, a plurality of toothed wheels supported by each of said guides and including at least one first toothed wheel and at least one second toothed wheel, at least one chain trained around each said plurality of toothed wheels, each said chain defining a closed-loop configuration having a central portion, at least two drive gears keyed to said second drive shaft and engaging said central portion of said closed-loop formation of each said chain, in meshing engagement relationship therewith, and wherein said guides each rotatably support at least one first toothed wheel and at least one second toothed wheel, and upwardly slideably support at least a portion of said closed-loop configuration defined by each of said chains.

2. A device according to claim 1, further comprising at least one chain member having at least one end and at least one other end, said at least one end being rigidly associated with said abutment means, said at least one other end of said chain member being anchored to said magazine.

3. A device according to claim 1, further comprising at least one chain member having at least one end and at least one other end, said at least one end being rigidly associated with said abutment means, said at least one other end of said chain member being anchored to said magazine, and wherein said magazine further comprises lateral walls and at least one coupling member, said lateral walls being spaced apart, said coupling member being located between lateral walls, said other end of said chain member being attached to said coupling member.

4. A device according to claim 1, further comprising;

at least one oscillatable element connected to said intermittent drive means, at least one transmission shaft, first connecting rod means connecting said oscillatable element to said transmission shaft, at least one non-return device, second connecting rod means connecting said transmission shaft to said non-return device, a plurality of gears actuated by said non-return device and transmitting motion from said non-return device to said second drive shaft.

5. A device according to claim 1, wherein said belts define at least two spaced-apart closed-loop formations, and wherein said chains define at least two closed-loop configurations, each being at least partially located between said closed loop formations defined by said belts.

6. A device according to claim 1, wherein said belts define at least two spaced-apart closed-loop formations, and wherein said chains define at least two closed-loop configurations, each being at least partially located between said closed loop formations defined by said belts, and wherein said chains and said belts are at least partially laterally superimposed.

7. A device according to claim 1, wherein said belts each define at least one closed-loop formation having a first longitudinal extension, wherein said chains each define at least one closed-loop configurations having a second longitudinal extension, and wherein said magazine defines a third longitudinal extension, a sum of said first longitudinal extension and said second longitudinal extension being greater than said third longitudinal extension.

8. Device for feeding flattened boxes from a folding-pasting machine to a packaging machine, said device comprising;

a supporting framework, at least one box magazine mounted on said framework and defining a box inlet zone, whereat flattened boxes are laid substantially horizontally and sequentially superimposed and a box extraction zone, abutment means located at said extraction zone for positioning boxes substantially vertically at said extraction zone of said magazine, first drive means, a first drive shaft rotatably associated with said framework and being driven by said first drive means, at least two drive pulleys keyed to said first drive shaft, intermittent drive means, a second drive shaft rotatably associated with said framework and being driven by said intermittent drive means, at least two return pulleys rotatably idly journalled on said second drive shaft, at least two belts trained around said drive pulleys and said return pulleys and each defining a closed-loop formation, at least one frame fixed to said fixed framework, at least two guides supported by said frame, a plurality of toothed wheels supported by each of said guides and including at least one first toothed wheel and at least one second toothed wheel, at least one chain trained around each said plurality of toothed wheels, each said chain defining a closed-loop configuration having a central portion, at least two drive gears keyed to said second drive shaft and engaging said central portion of said closed-loop formation of each said chain, in meshing engagement relationship therewith, wherein said closed-loop configurations defined by said chains and said closed-loop formations defined by said belts upwardly define a single uninterrupted linear advancement plane, and wherein said belts define at least two spaced-apart closed-loop formations, and wherein said chains define at least two closed-loop configurations, each being at least partially located between said closed loop formations defined by said belts.

9. A device according to claim 8, wherein said guides each rotatably support at least one first toothed wheel and at least one second toothed wheel, and upwardly slideably support at least a portion of said closed-loop configuration defined by each of said chains.

10. A device according to claim 8, further comprising at least one chain member having at least one end and at least one other end, said at least one end being rigidly associated with said abutment means, said at least one other end of said chain member being anchored to said magazine.

11. A device according to claim 10, wherein said magazine further comprises lateral walls and at least one coupling member, said lateral walls being spaced apart, said coupling member being located between lateral walls, said other end of said chain member being attached to said coupling member.

12. A device according to claim 8, further comprising;

at least one oscillatable element connected to said intermittent drive means, at least one transmission shaft, first connecting rod means connecting said oscillatable element to said transmission shaft, at least one non-return device, second connecting rod means connecting said transmission shaft to said non-return device, a plurality of gears actuated by said non-return device and transmitting motion from said non-return device to said second drive shaft, and wherein said belts define at least two spaced-apart closed-loop formations, and wherein said chains define at least two closed-loop configurations, each being at least partially located between said closed loop formations defined by said belts.

13. A device according to claim 8, wherein said chains and said belts are at least partially laterally superimposed.

14. A device according to claim 8, wherein said belts each define at least one closed-loop formation having a first longitudinal extension, wherein said chains each define at least one closed-loop configurations having a second longitudinal extension, and wherein said magazine defines a third longitudinal extension, a sum of said first longitudinal extension and said second longitudinal extension being greater than said third longitudinal extension.

15. Device for feeding flattened boxes from a folding-pasting machine to a packaging machine, said device comprising;

a supporting framework, at least one box magazine mounted on said framework and defining a box inlet zone, whereat flattened boxes are laid substantially horizontally and sequentially superimposed and a box extraction zone, abutment means located at said extraction zone for positioning boxes substantially vertically at said extraction zone of said magazine, first drive means, a first drive shaft rotatably associated with said framework and being driven by said first drive means, at least two drive pulleys keyed to said first drive shaft, intermittent drive means, a second drive shaft rotatably associated with said framework and being driven by said intermittent drive means, at least two return pulleys rotatably idly journalled on said second drive shaft, at least two belts trained around said drive pulleys and said return pulleys and each defining a closed-loop formation, at least one frame fixed to said fixed framework, at least two guides supported by said frame, a plurality of toothed wheels supported by each of said guides and including at least one first toothed wheel and at least one second toothed wheel, at least one chain trained around each said plurality of toothed wheels, each said chain defining a closed-loop configuration having a central portion, at least two drive gears keyed to said second drive shaft and engaging said central portion of said closed-loop formation of each said chain, in meshing engagement relationship therewith, wherein said closed-loop configurations defined by said chains and said closed-loop formations defined by said belts upwardly define a single uninterrupted linear advancement plane, and wherein said guides each rotatably support at least one first toothed wheel and at least one second toothed wheel, and upwardly slideably support at least a portion of said closed-loop configuration defined by each of said chains.

16. A device according to claim 15, further comprising at least one chain member having at least one end and at least one other end, said at least one end being rigidly associated with said abutment means, said at least one other end of said chain member being anchored to said magazine.

17. A device according to claim 15, wherein said magazine further comprises lateral walls and at least one coupling member, said lateral walls being spaced apart, said coupling member being located between lateral walls, said other end of said chain member being attached to said coupling member.

18. A device according to claim 15, further comprising;

at least one oscillatable element connected to said intermittent drive means, at least one transmission shaft, first connecting rod means connecting said oscillatable element to said transmission shaft, at least one non-return device, second connecting rod means connecting said transmission shaft to said non-return device, a plurality of gears actuated by said non-return device and transmitting motion from said non-return device to said second drive shaft.

* * * * *